US010488124B2

(12) United States Patent
Nishiyama et al.

(10) Patent No.: US 10,488,124 B2
(45) Date of Patent: Nov. 26, 2019

(54) CORRUGATED FIN HEAT EXCHANGER, REFRIGERATION CYCLE APPARATUS, APPARATUS FOR PRODUCING CORRUGATED FIN, AND METHOD FOR PRODUCING CORRUGATED FIN HEAT EXCHANGER

(71) Applicant: Mitsubishi Electric Corporation, Tokyo (JP)

(72) Inventors: Takumi Nishiyama, Tokyo (JP); Hideaki Maeyama, Tokyo (JP); Akira Ishibashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/558,582

(22) PCT Filed: May 12, 2015

(86) PCT No.: PCT/JP2015/063671
§ 371 (c)(1),
(2) Date: Sep. 15, 2017

(87) PCT Pub. No.: WO2016/181509
PCT Pub. Date: Nov. 17, 2016

(65) Prior Publication Data

US 2018/0058780 A1 Mar. 1, 2018

(51) Int. Cl.
*F28F 17/00* (2006.01)
*B21D 13/04* (2006.01)
(Continued)

(52) U.S. Cl.
CPC ..... *F28F 17/005* (2013.01); *B21D 13/04* (2013.01); *B21D 53/022* (2013.01);
(Continued)

(58) Field of Classification Search
CPC ..... F28F 17/005; F28F 1/128; F28F 1/126; F28F 19/006; F28F 2215/04; F28F 2215/00; F28F 2265/14; F28D 1/05366
(Continued)

(56) References Cited

U.S. PATENT DOCUMENTS 3,850,018 A * 11/1974 Drosnin ..... B21D 13/04 72/186
4,645,000 A * 2/1987 Scarselletta ..... F28D 1/05366 165/152
(Continued)

FOREIGN PATENT DOCUMENTS

JP S58-090334 A 5/1983
JP S59-008077 U 1/1984
(Continued)

OTHER PUBLICATIONS

International Search Report of the International Searching Authority dated Jul. 21, 2015 for the corresponding international application No. PCT/JP2015/063671 (and English translation).
(Continued)

*Primary Examiner* — Joel M Attey
(74) *Attorney, Agent, or Firm* — Posz Law Group, PLC

(57) ABSTRACT

A corrugated fin heat exchanger includes: a first flat tube; a second flat tube aligned in parallel with the first flat tube; and a corrugated fin disposed between the first flat tube and the second flat tube, and the corrugated fin includes a first slant portion bridging between the first flat tube and the second flat tube and inclined relative to a perpendicular line toward the first flat tube at a first angle of inclination, a second slant portion bridging between the first flat tube and the second flat tube and inclined relative to the perpendicular line at a second angle of inclination, and a third slant portion bridging between the first flat tube and the second flat tube, the third slant portion positioned between the first slant portion
(Continued)

and the second slant portion, and inclined relative to the perpendicular line at an angle of inclination larger than both of the first angle of inclination and the second angle of inclination.

14 Claims, 13 Drawing Sheets

(51) Int. Cl.
*B21D 53/02* (2006.01)
*F28D 1/053* (2006.01)
*F28F 1/12* (2006.01)
*F25B 39/00* (2006.01)

(52) U.S. Cl.
CPC ..... *F28D 1/05366* (2013.01); *F28F 1/128* (2013.01); *F25B 39/00* (2013.01); *F28F 2265/14* (2013.01)

(58) Field of Classification Search
USPC ..... 165/182, 152
See application file for complete search history.

(56) References Cited

U.S. PATENT DOCUMENTS 6,138,354 A 10/2000 Kobayashi et al.
2002/0179295 A1* 12/2002 Palanchon ..... F28D 1/0316 165/166

FOREIGN PATENT DOCUMENTS

| | | | |
|---|---|---|---|
| JP | H10-197180 | A | 7/1998 |
| JP | 2001-355981 | A | 12/2001 |
| JP | 2002-090083 | A | 3/2002 |
| JP | 2005-061648 | A | 3/2005 |
| JP | 2006-029615 | A | 2/2006 |
| JP | 2009-293900 | A | 12/2009 |
| JP | 2013-245883 | A | 12/2013 |

OTHER PUBLICATIONS

Office Action dated Jan. 11, 2019 issued in corresponding CN patent application No. 201580079561.8 (and English translation).
Office Action dated Sep. 9, 2019 issued in corresponding CN patent application No. 201580079561.8 (and English translation).

* cited by examiner

FIG. 6
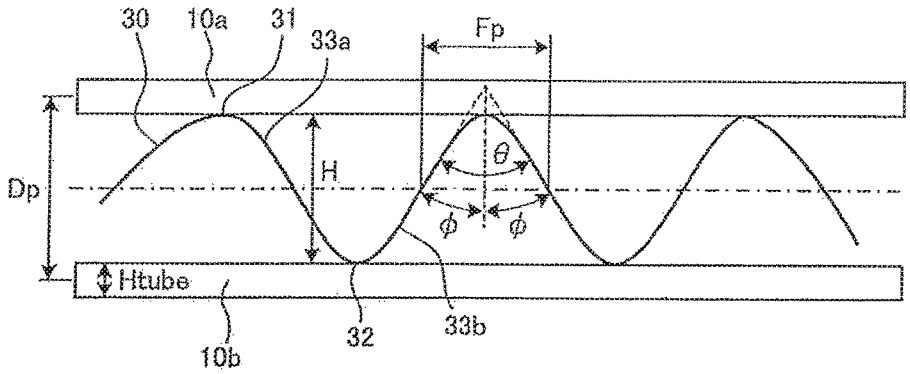
FIG. 7
| TEST RESULTS | | |
|---|---|---|
| Fp[mm] | 1.6 | 1.8 |
| Dp[mm] | 10.6 | 10.6 |
| Htube[mm] | 1.5 | 1.5 |
| H[mm] | 9.05 | 9.05 |
| θ [° ] | 20.1 | 22.5 |
| ϕ [° ] | 10.05 | 11.25 |
| BEHAVIOR OF FROST | UNSLIDING-DOWN | SLIDING-DOWN |
FIG. 8
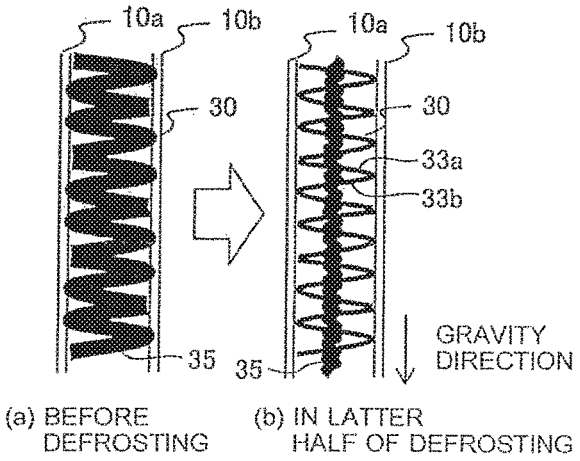

CORRUGATED FIN HEAT EXCHANGER, REFRIGERATION CYCLE APPARATUS, APPARATUS FOR PRODUCING CORRUGATED FIN, AND METHOD FOR PRODUCING CORRUGATED FIN HEAT EXCHANGER

CROSS REFERENCE TO RELATED APPLICATION

This application is a U.S. national stage application of PCT/JP2015/063671 filed on May 12, 2015, the contents of which are incorporated herein by reference.

TECHNICAL FIELD

The present invention relates to a corrugated fin heat exchanger, a refrigeration cycle apparatus, an apparatus for producing a corrugated fin, and a method for producing the corrugated fin heat exchanger.

BACKGROUND ART

Patent Literature 1 discloses a heat exchanger in which flat tubes and corrugated fins are alternately stacked in parallel in a lateral direction. Each corrugated fin of the heat exchanger includes an upper fin portion having a large angle of inclination and a lower fin portion having a small angle of inclination.

CITATION LIST

Patent Literature

Patent Literature 1: Japanese Unexamined Patent Application Publication No. 2002-90083

SUMMARY OF INVENTION

Technical Problem

At the lower fin portion having a small angle of inclination, water of melted frost generated during defrosting is hard to be drained. Thus, when defrosting of the heat exchanger of Patent Literature 1 is performed, water of melted frost is held concentrated in a lower portion of the heat exchanger. Therefore, there is a problem that the heat exchanger may be broken when water expands during re-frosting.

The present invention has been made in order to overcome the above-described problem, and an object of the present invention is to provide a corrugated fin heat exchanger that is able to prevent the heat exchanger from being broken, a refrigeration cycle apparatus, a method for producing a corrugated fin, and a method for producing the corrugated fin heat exchanger.

Solution to Problem

A corrugated fin heat exchanger according to an embodiment of the present invention includes: a first flat tube; a second flat tube aligned in parallel with the first flat tube; and a corrugated fin disposed between the first flat tube and the second flat tube; the corrugated fin including a first slant portion bridging between the first flat tube and the second flat tube and inclined relative to a perpendicular line toward the first flat tube at a first angle of inclination, a second slant portion bridging between the first flat tube and the second flat tube and inclined relative to the perpendicular line at a second angle of inclination, and a third slant portion bridging between the first flat tube and the second flat tube, the third slant portion positioned between the first slant portion and the second slant portion, and inclined relative to the perpendicular line at an angle of inclination larger than both of the first angle of inclination and the second angle of inclination.

In addition, a refrigeration cycle apparatus according to an embodiment of the present invention includes the corrugated fin heat exchanger.

In addition, a production apparatus for a corrugated fin according to an embodiment of the present invention includes: a supply unit configured to supply a band-shaped thin plate; a shaping unit configured to shape the thin plate supplied from the supply unit, into a corrugated shape; and a cutting unit configured to cut the thin plate shaped by the shaping unit, to produce the corrugated fin; the shaping unit including a pair of shaping rollers meshing with each other with the thin plate intervening therebetween; and a plurality of teeth having shapes different from each other are formed on an outer peripheral surface of each of the pair of shaping rollers.

In addition, a method for producing a corrugated fin heat exchanger according to an embodiment of the present invention is a method for producing the corrugated fin heat exchanger, the method including a step of producing the corrugated fin by using the production apparatus for the corrugated fin.

Advantageous Effects of Invention

According to the embodiments of the present invention, it is possible to prevent the corrugated fin heat exchanger from being broken.

BRIEF DESCRIPTION OF DRAWINGS

FIG. 6 is a front view showing the configuration of a part of a corrugated fin heat exchanger used in an actual machine test for Embodiment 1 of the present invention.

FIG. 7 is a diagram showing results of the actual machine test for Embodiment 1 of the present invention.

FIG. 8 is a diagram showing (a) a state before defrosting of a corrugated fin heat exchanger having a fin pitch Fp of 1.6 mm and (b) a state in the latter half of defrosting thereof, in the actual machine test for Embodiment 1 of the present invention.

DESCRIPTION OF EMBODIMENTS

Embodiment 1

Figure 1:
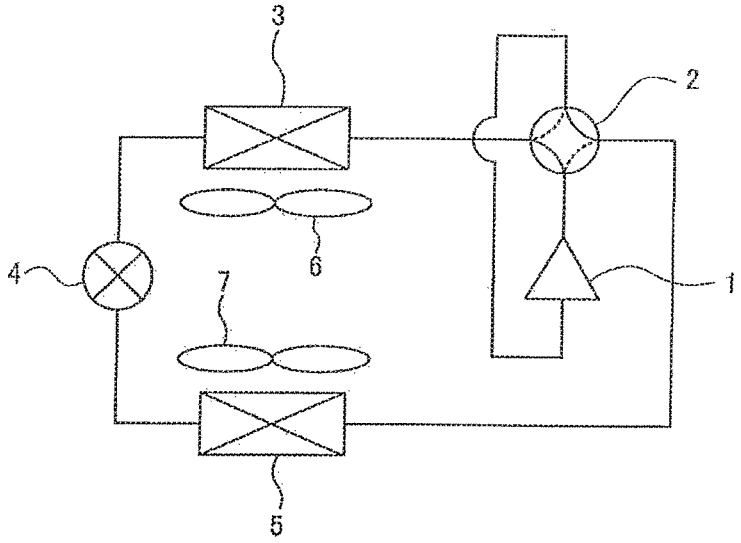
FIG. 1 is a refrigerant circuit diagram showing a schematic configuration of a refrigeration cycle apparatus according to Embodiment 1 of the present invention.

A corrugated fin heat exchanger, a refrigeration cycle apparatus, a production apparatus for a corrugated fin, and a method for producing the corrugated fin heat exchanger according to Embodiment 1 of the present invention will be described. FIG. 1 is a refrigerant circuit diagram showing a schematic configuration of the refrigeration cycle apparatus according to Embodiment 1. In Embodiment 1, an air-conditioning apparatus is shown as an example of the refrigeration cycle apparatus. In drawings described below including FIG. 1, the relationship between the dimensions, the shapes, and the like of respective components may be different from actual relationship, shapes, and the like. In addition, in principle, the positional relationship (e.g., the vertical relationship) between respective components in the following description is that when the refrigeration cycle apparatus including the corrugated fin heat exchanger is installed in a usable state.

As shown in FIG. 1, the refrigeration cycle apparatus has a configuration in which a compressor 1, a four-way valve 2, a heat source side heat exchanger 3, a pressure reducing device 4, and a load side heat exchanger 5 are connected in a circuit via a refrigerant pipe. In addition, the refrigeration cycle apparatus includes an air-sending fan 6 that sends air to the heat source side heat exchanger 3, and an air-sending fan 7 that sends air to the load side heat exchanger 5. FIG. 1 shows only minimum necessary components as an air-conditioning apparatus that performs both cooling operation and heating operation. The refrigeration cycle apparatus may include, in addition to the components shown in FIG. 1, pressure measuring means, a gas-liquid separator, a receiver, and an accumulator.

The compressor 1 is a fluid machine that compresses low-pressure refrigerant sucked therein and discharges the refrigerant as high-pressure refrigerant. The four-way valve 2 serves to switch the flow direction of the refrigerant in a refrigeration cycle between during cooling operation and during heating operation. The heat source side heat exchanger 3 is a heat exchanger that serves as a radiator (e.g., a condenser) during cooling operation and serves as an evaporator during heating operation. In the heat source side heat exchanger 3, heat is exchanged between the refrigerant flowing therein and air (outside air) sent by the air-sending fan 6. The pressure reducing device 4 serves to reduce the pressure of the high-pressure refrigerant to make the refrigerant into low-pressure refrigerant. As the pressure reducing device 4, for example, an electronic expansion valve capable of adjusting an opening degree or another valve is used. The load side heat exchanger 5 is a heat exchanger that serves as an evaporator during cooling operation and serves as a radiator (e.g., a condenser) during heating operation. In the load side heat exchanger 5, heat is exchanged between the refrigerant flowing therein and air sent by the air-sending fan 7. Here, cooling operation refers to an operation in which the low-temperature and low-pressure refrigerant is supplied to the load side heat exchanger 5, and heating operation refers to an operation in which the high-temperature and high-pressure refrigerant is supplied to the load side heat exchanger 5.

When cooling operation or heating operation is continued over a long time period, frost occurs in the heat exchanger that serves as an evaporator, and the heat exchange efficiency of the heat exchanger may decrease. Therefore, when a condition for occurrence of frost is satisfied and cooling operation or heating operation is continued for a predetermined time period, defrosting operation is performed in which the flow direction of the refrigerant is switched by the four-way valve 2 and the high-temperature and high-pressure refrigerant (hot gas) is supplied to the evaporator. Whether the condition for occurrence of frost is satisfied is determined by a controller, which is not shown, on the basis of, for example, the dry-bulb temperature (e.g., 2 degrees C. or lower) and the relative humidity (e.g., 93.1% or higher) of the air at the evaporator side.

Figure 2:
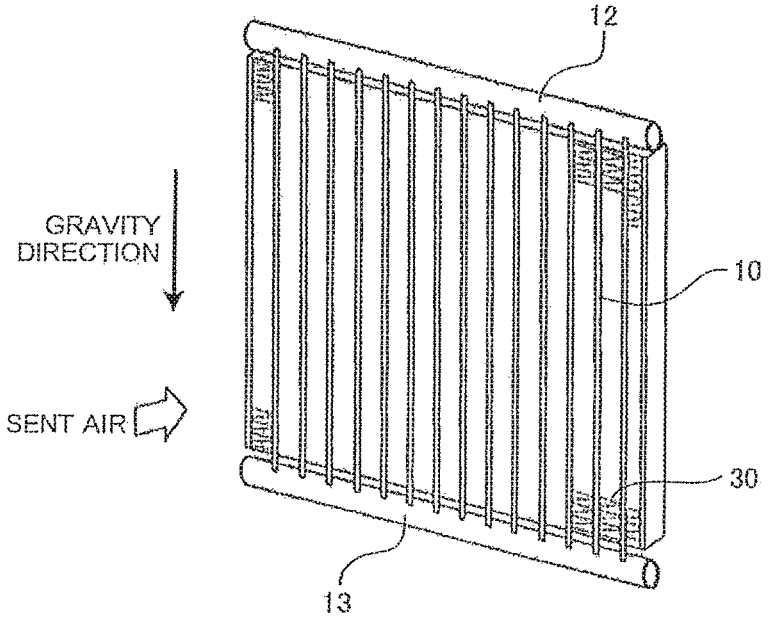
FIG. 2 is a perspective view showing the configuration of a corrugated fin heat exchanger according to Embodiment 1 of the present invention.

FIG. 2 is a perspective view showing the configuration of the corrugated fin heat exchanger according to Embodiment 1. In Embodiment 1, the corrugated fin heat exchanger is used as at least one of the heat source side heat exchanger 3 and the load side heat exchanger 5. As shown in FIG. 2, the corrugated fin heat exchanger according to Embodiment 1 is of a vertical flow type in which internal fluid (the refrigerant in Embodiment 1) is caused to flow in the vertical direction. The corrugated fin heat exchanger has a configuration in which a plurality of flat tubes 10 aligned in parallel with each other and extending in the vertical direction (gravity direction) and at least one corrugated fin 30 disposed between the adjacent two flat tubes 10 are alternately stacked. The upper end of each flat tube 10 is connected to an upper header 12, and the lower end of each flat tube 10 is connected to a lower header 13. Each corrugated fin 30 has a configuration in which a metal plate is formed in a corrugated shape (wavy shape). In the corrugated fin heat exchanger, heat is exchanged between the refrigerant flowing in the vertical direction within the flat tubes 10 and sent air flowing in a direction crossing (e.g., orthogonal to) both the gravity direction and the stacking direction of the flat tubes 10.

Figure 3:
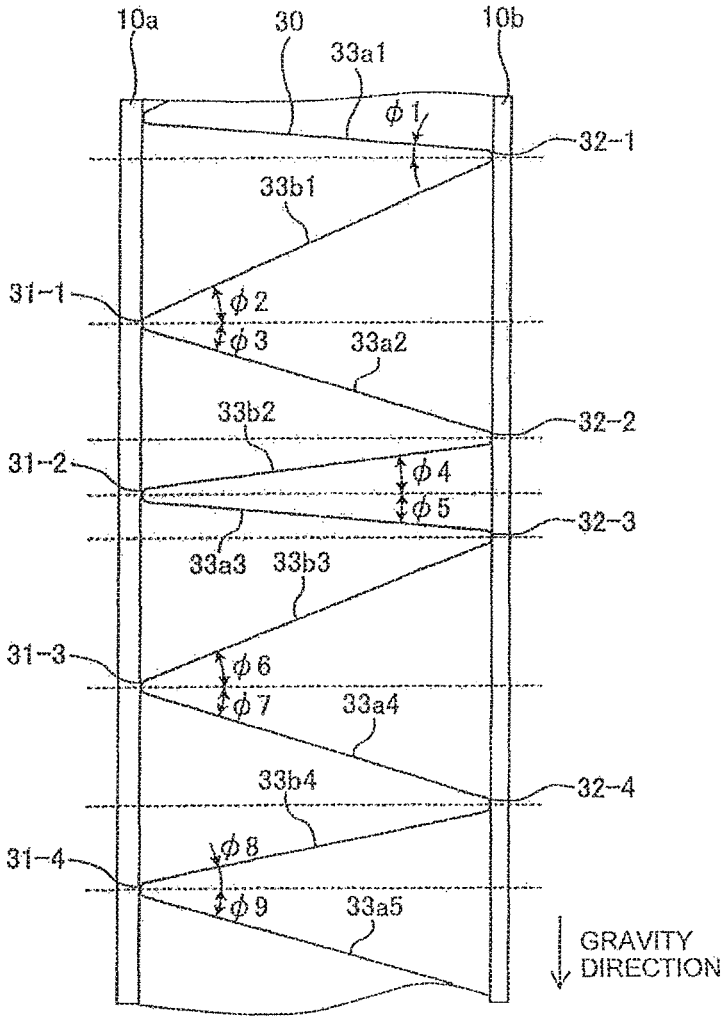
FIG. 3 is a front view showing the configuration of a corrugated fin 30 in the corrugated fin heat exchanger according to Embodiment 1 of the present invention.

FIG. 3 is a front view showing the configuration of the corrugated fin 30 in the corrugated fin heat exchanger according to Embodiment 1 as seen in the flow direction of the sent air. FIG. 3 shows adjacent two flat tubes 10*a* and 10*b* and one corrugated fin 30 disposed between the flat tubes 10*a* and 10*b*. As shown in FIG. 3, the corrugated fin 30 includes: a plurality of top portions 31 that are in contact with the one flat tube 10*a*, a plurality of top portions 32 that are in contact with the other flat tube 10*b*, and a plurality of slant portions each provided between the top portion 31 and the top portion 32 and bridging between the flat tubes 10*a* and 10*b*. Hereinafter, the slant portions extending downward to the right in FIG. 3 are referred to as slant portions 33*a* (including slant portions 33*a*1, 33*a*2, . . . ), and the slant portions extending downward to the left in FIG. 3 are referred to as slant portions 33*b* (including slant portions 33*b*1, 33*b*2, . . . ). The flat tube 10*a* and the top portions 31, and the flat tube 10*b* and the top portions 32, are joined by means of, for example, brazing.

In the configuration of this example, the multiple slant portions 33*a* are not necessarily parallel with each other. In addition, the multiple slant portions 33*b* are not necessarily parallel with each other. That is, the multiple slant portions 33*a* and 33*b* are inclined at a plurality of patterns of angles of inclination (e.g., angles of inclination φ1 to φ9) relative to a perpendicular line toward the flat tube 10*a*. Here, when the corrugated fin heat exchanger is installed in a state where the corrugated fin heat exchanger is usable, perpendicular lines from the respective slant portions 33*a* and 33*b* toward the flat tube 10*a* are horizontal. In this example, the multiple slant portions 33*a* and 33*b* include at least steep slant portions that are inclined at a relatively large angle of inclination (e.g., the angles of inclination φ2, φ3, φ6, φ7, φ8, and φ9) relative to the perpendicular line toward the flat tube 10*a* (e.g., the slant portions 33*a*1, 33*b*2, and 33*a*3) and gentle slant portions that are inclined at a relatively small angle of inclination (e.g., the angles of inclination φ1, φ4, and φ5) relative to the perpendicular line toward the flat tube 10*a* (e.g., the slant portions 33*b*1, 33*a*2, 33*b*3, 33*a*4, 33*b*4, and 33*a*5). Here, the angles of inclination of the respective steep slant portions may be different form each other. In addition, the angles of inclination of the respective gentle slant portions may be different form each other. However, as described later, the angles of inclination of the steep slant portions are preferably greater than 10.05 degrees and more preferably 11.25 degrees or greater. In one corrugated fin 30, the gentle slant portions are provided at a plurality of locations with at least one steep slant portion positioned therebetween. In the range shown in FIG. 3, the gentle slant portions are provided at two locations with two steep slant portions (the slant portions 33*b*1 and 33*a*2) positioned therebetween. In addition, in one corrugated fin 30, the steep slant portions are provided at a plurality of locations with at least one gentle slant portion positioned therebetween. In the range shown in FIG. 3, the steep slant portions are provided at two locations with two gentle slant portions (the slant portions 33*b*2 and 33*a*3) positioned therebetween.

Each of the multiple slant portions 33*a* and 33*b* is formed such that an end thereof on the lower end side of the corrugated fin 30 is positioned lower than the other end thereof on the upper end side of the corrugated fin 30. Thus, the corrugated fin 30 has a configuration in which each of the slant portions is slanted monotonously downward from the upper end portion toward the lower end portion. Here, the upper end portion of the corrugated fin 30 is the end portion at the upper header 12 side that is located at the upper side in the FIG. 2, and the lower end portion of the corrugated fin 30 is the end portion at the lower header 13 side that is located at the lower side in FIG. 2.

The plurality of top portions 31 (including top portions 31-1, 31-2, . . . ) and the plurality of top portions 32 (including top portions 32-1, 32-2, . . . ) respectively have a plurality of patterns of vertex angles. The vertex angle of each top portion 31 or 32 is defined as the sum of the angles of inclination of the slant portion 33*a* and the slant portion 33*b* located at both sides with the top portion 31 or 32 intervening therebetween. In this example, the top portions 31 and 32 include at least large vertex angle portions having a first vertex angle (e.g., the sum of relatively large angles of inclination) that is a relatively large angle (e.g., the top portions 31-1, 31-3, 32-4, and 31-4), intermediate vertex angle portions having a second vertex angle (e.g., the sum of a relatively large angle of inclination and a relatively small angle of inclination) smaller than the first vertex angle (e.g., the top portions 32-1, 32-2, and 32-3), and small vertex angle portions having a third vertex angle (e.g., the sum of relatively small angles of inclination) smaller than the second vertex angle (e.g., the top portion 31-2). In one corrugated fin 30, the large vertex angle portions are provided at a plurality of locations with one or more small vertex angle portions or intermediate vertex angle portions intervening therebetween, the intermediate vertex angle portions are provided at a plurality of locations with one or more small vertex angle portions or large vertex angle portions intervening therebetween, and the small vertex angle portions are provided at a plurality of locations with one or more intermediate vertex angle portions or large vertex angle portions intervening therebetween.

Figure 4:
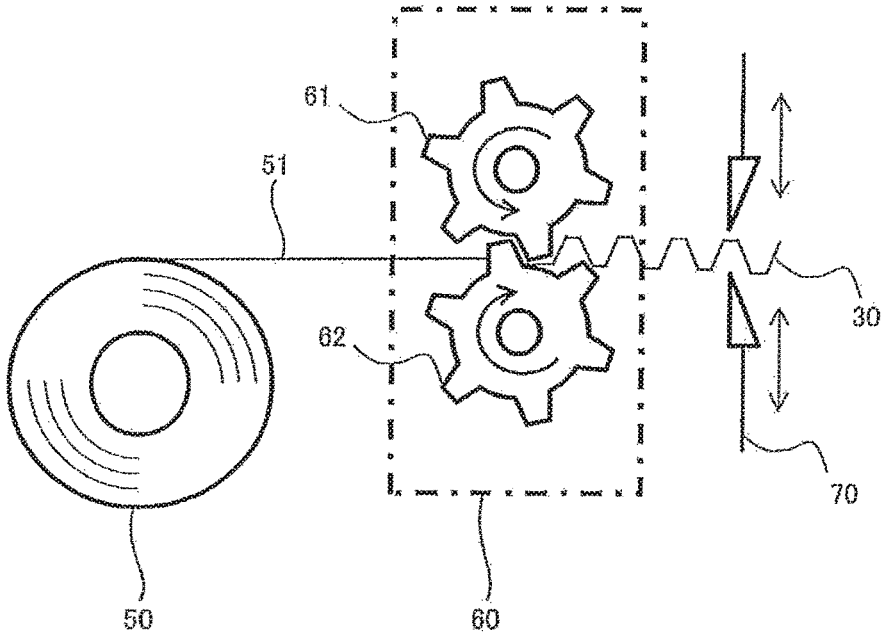
FIG. 4 is a schematic diagram showing a production process for the corrugated fin 30 as a part of a production process for the corrugated fin heat exchanger according to Embodiment 1 of the present invention, and a production apparatus used in the process.

FIG. 4 is a schematic diagram showing a production process for the corrugated fin 30 as a part of a production process for the corrugated fin heat exchanger according to Embodiment 1, and a production apparatus used in the process. As shown in FIG. 4, the production apparatus used in the production process for the corrugated fin 30 includes a supply unit 50, a shaping unit 60, and a cutting unit 70.

The supply unit 50 includes a drum that holds a thin plate 51 made of metal (e.g., aluminum) wound in a roll shape. The supply unit 50 is configured to rotate the drum to supply the band-shaped thin plate 51 to the shaping unit 60 at the downstream side.

The shaping unit 60 serves to shape the supplied thin plate 51 into a corrugated shape. The shaping unit 60 includes a pair of shaping rollers 61 and 62. On the outer peripheral surfaces of the respective shaping rollers 61 and 62, a plurality of teeth are provided along the axial directions thereof and mesh with each other with the thin plate 51 intervening therebetween.

Figure 5:
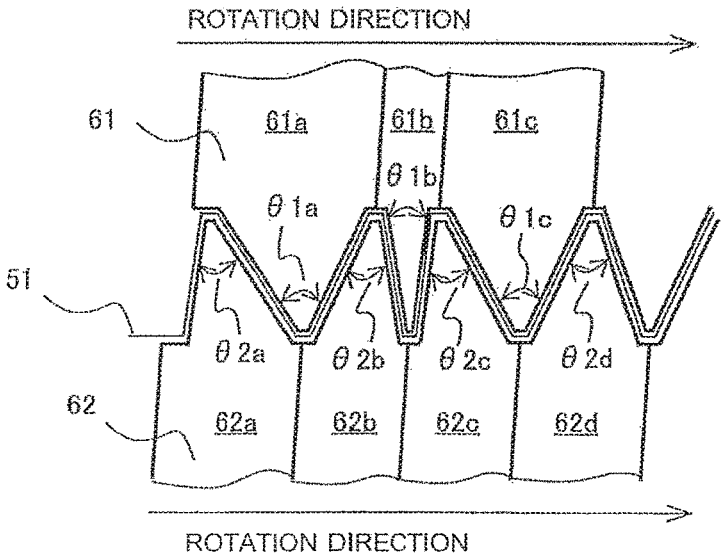
FIG. 5 is a diagram showing a schematic configuration in which the outer peripheral surface of each of shaping rollers 61 and 62 is developed along a supply direction of a thin plate 51 in the production apparatus for the corrugated fin heat exchanger according to Embodiment 1 of the present invention.

FIG. 5 is a diagram showing a schematic configuration in which the outer peripheral surfaces of the respective shaping rollers 61 and 62 are developed along a supply direction of the thin plate 51 (the right-left direction in the drawing). As shown in FIG. 5, a plurality of teeth 61*a*, 61*b*, and 61*c* having shapes (e.g., vertex angles) different from each other are provided on the outer peripheral surface of the shaping roller 61 so as to project radially outward. In FIG. 5, a vertex angle of the tooth 61*a* is θ1*a*, a vertex angle of the tooth 61*b* is θ1*b*, and a vertex angle of the tooth 61*c* is θ1*c*. In addition, a plurality of teeth 62*a*, 62*b*, 62*c*, and 62*d* that mesh with the teeth 61*a*, 61*b*, and 61*c* and have shapes (e.g., vertex angles) different form each other are provided on the outer peripheral surface of the shaping roller 62 so as to project radially outward. In FIG. 5, a vertex angle of the tooth 62*a* is θ2*a*, a vertex angle of the tooth 62*b* is θ2*b*, a vertex angle of the tooth 62*c* is θ2*c*, and a vertex angle of the tooth 62*d* is θ2*d*. For example, the vertex angles θ1*a* and θ1*c* correspond to the above first vertex angle, which is the relatively large angle. The vertex angles θ2*a*, θ2*b*, θ2*c*, and θ2*d* correspond to the above second vertex angle, which is smaller than the first vertex angle. The vertex angle θ1*b* corresponds to the above third vertex angle, which is smaller than the second vertex angle.

The cutting unit 70 serves to cut the thin plate 51 shaped into the corrugated shape by the shaping unit 60, in a predetermined length to produce the corrugated fin 30.

In the production process for the corrugated fin 30, the band-shaped thin plate 51 supplied from the supply unit 50 is shaped by the shaping rollers 61 and 62, and the shaped thin plate 51 is cut in a predetermined length by the cutting unit 70. Accordingly, the corrugated fin 30 having a plurality of top portions 31 and 32 having vertex angles different from each other.

A plurality of the corrugated fins 30 produced and a plurality of flat tubes 10 produced in another process are alternately stacked, and a pair of side plates and the like are disposed at both end sides in the stacking direction. Then, the upper header 12 and the lower header 13 are connected to one end and another end of each flat tube 10, respectively. Accordingly, an assembly of the corrugated fin heat exchanger is produced. The produced assembly is heated to a temperature equal to or higher than the melting point of a brazing material, whereby the components of the assembly are brazed to each other, so that the corrugated fin heat exchanger is produced.

Next, the angles of inclination φ of the slant portions 33*a* and 33*b* will be described on the basis of results of an actual machine test. FIG. 6 is a front view showing the configuration of a part of a corrugated fin heat exchanger used in the actual machine test. Here, when the distance between the central axis of the flat tube 10*a* and the central axis of the flat tube 10*b* is denoted by Dp [mm], the height of each of the flat tubes 10*a* and 10*b* in a stacking direction (the up-down direction in FIG. 6) is denoted by Htube [mm], the distance (fin height) between the top portion 31 and the top portion 32 of the corrugated fin 30 in the stacking direction is denoted by H [mm] (=Dp−Htube), the distance (fin pitch) from the middle position between the top portion 31 and the top portion 32 of the corrugated fin 30 to the next middle position is denoted by Fp [mm], the vertex angle of the top portion 31 or 32 of the corrugated fin 30 is denoted by θ [degrees], and the flow direction of the internal fluid is set to be the gravity direction, the angle of inclination of each slant portion 33*a* or 33*b* is denoted by φ[degrees] (e.g., φ=θ/2). In this example, the range of the vertex angle θ is set as 0 degrees<θ<180 degrees, and the range of the angle of inclination φ is set as 0 degrees<φ<90 degrees. In addition, in this example, each parameter described above including the fin pitch Fp, the vertex angle θ, and the angle of inclination φ is substantially uniform over the entirety of the heat exchanger. Moreover, the vertex angle θ is calculated by the following equation using the fin pitch Fp and the fin height H.

$$\theta=2\times\tan^{-1}((Fp/2)/(H/2))$$

FIG. 7 is a diagram showing the results of the actual machine test. In the actual machine test, behavior of frost (particularly, presence/absence of sliding-down of frost on the slant portions 33*a* and 33*b*) during defrosting was evaluated by using a corrugated fin heat exchanger having a fin pitch Fp of 1.6 mm (θ=20.1 degrees, φ=10.05 degrees) and a corrugated fin heat exchanger having a fin pitch Fp of 1.8 mm (θ=22.5 degrees, φ=11.25 degrees).

FIG. 8 is a diagram showing (a) a state before defrosting of the corrugated fin heat exchanger having a fin pitch Fp of 1.6 mm (φ=10.05 degrees) and (b) a state in the latter half of defrosting thereof. As shown in FIG. 8(*a*), in the state before defrosting, frost 35 adhered over the entirety of the corrugated fin 30. In this state, hot gas was passed through the flat tubes 10*a* and 10*b* to start defrosting. At the center portion of each slant portion 33*a* or 33*b* of the corrugated fin 30, the fin efficiency is low since the distance from the flat tubes 10*a* and 10*b* thereto is large. Therefore, as shown in FIG. 8(*b*), even in the latter half of defrosting, the sherbet-like frost 35 remained on the center portion of each slant portion 33*a* or 33*b*. Thus, a relatively long time period was taken until completion of defrosting. Only part of the frost 35 slid down on the slant portions 33*a* and 33*b*, and sufficient sliding-down of the frost 35 did not occur as a whole. Thus, behavior of frost was evaluated as "unsliding-down" (see FIG. 7).

Figure 9:
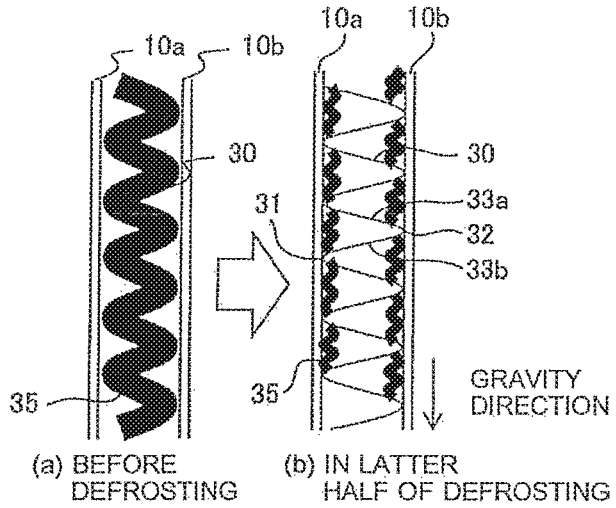
FIG. 9 is a diagram showing (a) a state before defrosting of a corrugated fin heat exchanger having a fin pitch Fp of 1.8 mm and (b) a state in the latter half of defrosting thereof, in the actual machine test for Embodiment 1 of the present invention.

FIG. 9 is diagram showing (a) a state before defrosting of the corrugated fin heat exchanger having a fin pitch Fp of 1.8 mm (φ=11.25 degrees) and (b) a state in the latter half of defrosting thereof. As shown in FIG. 9(*a*), in the state before defrosting, frost 35 adhered over the entirety of the corrugated fin 30. In this state, hot gas was passed through the flat tubes 10*a* and 10*b* to start defrosting. In this configuration as well, in the first half of defrosting, similarly as in FIG. 8(*b*), the sherbet-like frost 35 remained on the center portion of each slant portion 33*a* or 33*b* of the corrugated fin 30. However, substantially the entirety of the remaining frost 35 slid down along each slant portion 33*a* or 33*b* to the vicinity of the top portion 31 or 32 in the latter half of defrosting (FIG. 9(*b*)). Since most of the frost 35 on the slant portions 33*a* and 33*b* slid down, behavior of frost was evaluated as "sliding-down" (see FIG. 7). Since the fin efficiency is high in the vicinities of the top portions 31 and 32, and the top portions 31 and 32 are close to the flat tubes 10*a* and 10*b*, the frost 35 sliding-down to the vicinities of the top portions 31 and 32 was melted in a short time. Thus, in the configuration of FIG. 9, it was possible to shorten a time period until completion of defrosting as compared to that in the configuration of FIG. 8.

From the results of the actual machine test, it was found that when the angles of inclination φ of the slant portions 33*a* and 33*b* of the corrugated fin heat exchanger are increased, it is possible to shorten a defrosting time period, since it is possible to allow the frost 35 to slide down from the center portions of the slant portions 33*a* and 33*b* to the vicinities of the top portions 31 and 32. In addition, it was found that, to allow the frost 35 to slide down on the slant portions 33*a* and 33*b* that are steep slant portions, the angle of inclination φ is preferably greater than 10.05 degrees (e.g., the vertex angle θ is greater than 20.1 degrees), and the angle of inclination φ is more preferably 11.25 degrees or greater (e.g., the vertex angle θ is 22.5 degrees or greater).

However, when the angle of inclination φ is excessively increased, the heat-transfer area decreases due to the fin pitch Fp becoming large, so that the heat exchange efficiency of the heat exchanger decreases. Therefore, it was found that the angle of inclination φ of each slant portion 33*a* or 33*b* that is the steep slant portion is preferably, for example, approximately 11.25 degrees.

Figure 10:
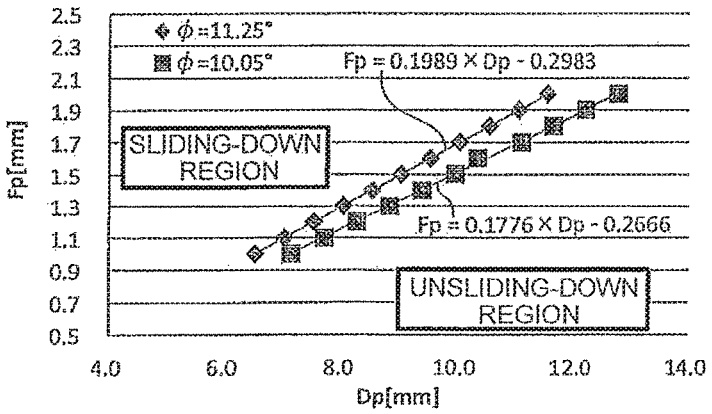
FIG. 10 is a boundary diagram showing a boundary between presence and absence of sliding-down of frost 35 in the corrugated fin heat exchanger according to Embodiment 1 of the present invention.

FIG. 10 is a boundary diagram showing a boundary between presence and absence of sliding-down of the frost 35 in the relationship between the distance Dp between the adjacent flat tubes 10 and the fin pitch Fp. In FIG. 10, the horizontal axis represents the distance Dp, and the vertical axis represents the fin pitch Fp. To make the angle of inclination φ of each slant portion 33*a* or 33*b* larger than at least 10.05 degrees, the distance Dp and the fin pitch Fp need to satisfy the relationship of the following expression (1).

$$Fp>0.1776\times Dp-0.2666 \quad (1)$$

In FIG. 10, the region in which the distance Dp and the fin pitch Fp do not satisfy the relationship of the expression (1) is shown as an "unsliding-down region". That is, when the relationship between the distance Dp and the fin pitch Fp is included in the unsliding-down region, it is not possible to sufficiently slide down the frost 35 during defrosting.

In addition, to make the angle of inclination φ of each slant portion 33*a*, 33*b* equal to or greater than 11.25 degrees, the distance Dp and the fin pitch Fp need to satisfy the relationship of the following expression (2).

$$Fp\geq 0.1989\times Dp-0.2983 \quad (2)$$

In FIG. 10, the region in which the distance Dp and the fin pitch Fp satisfy the relationship of the expression (2) is shown as a "sliding-down region". That is, when the relationship between the distance Dp and the fin pitch Fp is included in the sliding-down region, it is possible to sufficiently slide down the frost 35 during defrosting.

Figure 11:
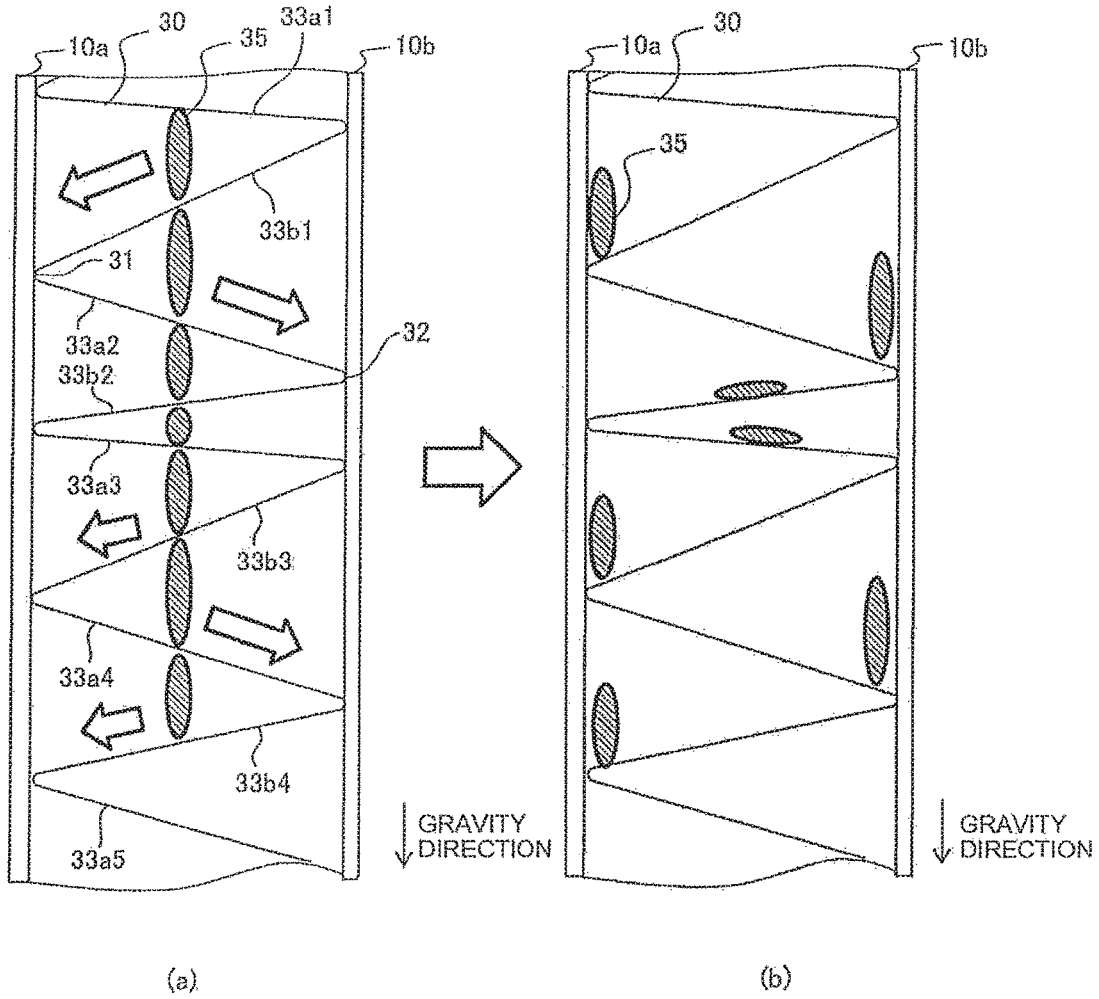
FIG. 11 is an explanatory diagram showing an example of behavior of frost 35 during defrosting in the corrugated fin heat exchanger according to Embodiment 1 of the present invention, and a diagram showing (a) a state in the first half of defrosting and (b) a state in the latter half of defrosting thereof.

Next, an operation during defrosting of the corrugated fin heat exchanger according to Embodiment 1 will be described. FIG. 11 is an explanatory diagram showing an example of behavior of frost in the corrugated fin heat exchanger, and a diagram showing (a) a state in the first half of defrosting and (b) a state in a later period of defrosting thereof. In FIG. 11, (a) and (b) are front views corresponding to those of FIG. 3. Here, in the refrigeration cycle apparatus according to Embodiment 1, when the condition for occurrence of frost (e.g., the dry-bulb temperature of air at the evaporator side is 2 degrees C. or lower and the relative humidity is 93.1% or higher) is satisfied, the four-way valve 2 is switched for defrosting, and high-temperature refrigerant (hot gas) flows through the flat tubes 10 of the corrugated fin heat exchanger.

As shown in FIG. 11(*a*), in the first half of defrosting, frost 35 remains on the center portion of each slant portion 33*a* or 33*b* at which the fin efficiency is low.

As shown in FIG. 11(*b*), in the latter half of defrosting, the frost 35 on the slant portions 33*b*1, 33*a*2, 33*b*3, 33*a*4, and 33*b*4 (steep slant portions) inclined at a relatively large angle of inclination φ(e.g., φ>10.05 degrees) slides down to the vicinity of the flat tube 10*a* or the flat tube 10*b*. Thus, the frost 35 that has slid down is melted immediately in the vicinity of the flat tube 10*a* or the flat tube 10*b* at which the fin efficiency is high. Therefore, it is possible to shorten the time period required for defrosting.

On the other hand, as shown in FIG. 11(*b*), the frost 35 on the slant portions 33*b*2 and 33*a*3 (gentle slant portions) inclined at a relatively small angle of inclination φ (e.g., φ10.05 degrees) almost does not slide down to the vicinity of the flat tube 10*a* or the flat tube 10*b*. Thus, the frost 35 is melted on the center portions of the slant portions 33*b*2 and 33*a*3. At the gentle slant portions such as the slant portions 33*b*2 and 33*a*3, the distance between the top portion 31 and the top portion 32 is shorter than that at the steep slant portions, and thus the fin efficiency is high. Therefore, even when the frost 35 is melted on the center portions of the slant portions 33*b*2 and 33*a*3, it is possible to further shorten the time period required for defrosting.

Melted water generated due to defrosting is drained downward on the corrugated fin 30 and the flat tubes 10*a* and 10*b*.

Here, it is assumed that all the slant portions 33*a* and 33*b* of the corrugated fin 30 are gentle slant portions inclined at a relatively small angle of inclination φ(e.g., φ≤10.05 degrees). In this case, sliding-down of the frost 35 does not occur on all the slant portions 33*a* and 33*b*, and thus the time period required for defrosting becomes relatively long. On the other hand, the fin pitch Fp becomes small and the heat transfer area becomes large, and thus the heat exchange efficiency becomes high.

Next, it is assumed that all the slant portions 33*a* and 33*b* of the corrugated fin 30 are steep slant portions inclined at a relatively large angle of inclination φ(e.g., φ>10.05 degrees). In this case, sliding-down of the frost 35 occurs on all the slant portions 33*a* and 33*b*, and thus the time period required for defrosting is shortened. On the other hand, the fin pitch Fp becomes large and the heat transfer area decreases, and thus the heat exchange efficiency decreases.

When gentle slant portions and steep slant portions are present together as in Embodiment 1, it is effective to partially densely dispose the gentle slant portions having a smaller angle of inclination in order to make sliding-down of frost occur on more slant portions and decrease the average fin pitch. In this case, the number of the steep slant portions of the corrugated fin 30 is smaller than the number of the gentle slant portions.

As described above, the corrugated fin heat exchanger according to Embodiment 1 includes the flat tubes 10*a* and 10*b* aligned in parallel with each other, and the corrugated fin 30 disposed between the flat tube 10*a* and the flat tube 10*b*, and the corrugated fin 30 includes: the slant portion 33*a*1 (an example of a first slant portion) and the slant portion 33*b*2 (an example of a second slant portion) that bridge between the flat tube 10*a* and the flat tube 10*b* and are inclined at an angle of inclination φ1 (an example of a first angle of inclination) and an angle of inclination φ4 (an example of a second angle of inclination) relative to the perpendicular line toward the flat tube 10*a*, respectively; and the slant portion 33*b*1 and the slant portion 33*a*2 (an example of a third slant portion) that bridge between the flat tube 10*a* and the flat tube 10*b*, are disposed between the slant portion 33*a*1 and the slant portion 33*b*2, and are inclined at an angle of inclination φ2 and an angle of inclination φ3 larger than both of the angle of inclination φ1 and the angle of inclination φ4, relative to the perpendicular line toward the flat tube 10*a*, respectively. In addition, the refrigeration cycle apparatus according to Embodiment 1 includes the above-described corrugated fin heat exchanger.

According to the configuration, when defrosting is performed, it is possible to slide down the frost 35 on the slant portions 33*b*1 and 33*a*2 to the vicinity of the flat tube 10*a* or the flat tube 10*b*, and thus it is possible to immediately melt the frost 35. In addition, at the slant portions 33*a*1 and 33*b*2 at which sliding-down of the frost 35 is hard to occur, the fin efficiency is higher than that at the slant portions 33*b*1 and 33*a*2, and thus it is possible to melt the frost 35 in a relatively short time period. Therefore, it is possible to melt the frost 35 on portions at which the fin efficiency is relatively high (e.g., portions other than the steep slant portions) in a dispersed manner, so that it is possible to shorten the defrosting time period. Furthermore, by shortening the defrosting time period, it is possible to reduce the energy required for defrosting, and thus it is possible to achieve energy saving of the refrigeration cycle apparatus.

In addition, by causing steep slant portions and gentle slant portions to be present together in one corrugated fin 30, it is possible to decrease the average fin pitch Fp, and thus it is possible to inhibit the heat transfer area of the corrugated fin 30 from decreasing. Accordingly, it is possible to maintain the heat exchange efficiency as the heat exchanger while shortening the defrosting time period.

In addition, gentle slant portions on which water of melted frost during defrosting is hard to be drained are provided at a plurality of locations with steep slant portions positioned therebetween. Accordingly, it is possible to disperse the gentle slant portions without making the gentle slant portions dense, and thus it is possible to prevent water of melted frost from being held concentrated in a specific portion of the heat exchanger at end of defrosting. Therefore, even when water expands during re-frosting, it is possible to prevent the heat exchanger from being broken. Thus, it is possible to increase the life of the corrugated fin heat exchanger.

In addition, in the corrugated fin heat exchanger according to Embodiment 1, each of the angles of inclination φ1 and φ4 is 10.05 degrees or less, and each of the angles of inclination φ2 and φ3 is greater than 10.05 degrees. Accordingly, during defrosting, it is possible to slide down the frost 35 on the steep slant portions to the flat tubes 10. Moreover, it is possible to decrease the average fin pitch Fp, and it is possible to inhibit the heat transfer area of the corrugated fin 30 from decreasing.

In addition, in the corrugated fin heat exchanger according to Embodiment 1, each of the angles of inclination φ2 and φ3 may be 11.25 degrees or greater. Accordingly, during defrosting, it is possible to more assuredly slide down the frost 35 on the steep slant portions to the flat tubes 10.

In addition, in the corrugated fin heat exchanger according to Embodiment 1, the corrugated fin 30 has a plurality of slant portions including the slant portions 33*a*1, 33*b*1, 33*a*2, and 33*b*2, and the number of the slant portions inclined at an angle of inclination greater than 10.05 degrees relative to the perpendicular line toward the flat tube 10*a*, of the plurality of slant portions, may be smaller than the number of the slant portions inclined at an angle of inclination 10.05 degrees or less relative to the perpendicular line toward the flat tube 10*a*. Accordingly, it is possible to cause sliding-down of frost on more slant portions while keeping the average fin pitch Fp small.

In addition, in the corrugated fin heat exchanger according to Embodiment 1, each of the plurality of slant portions 33*a* and 33*b* is formed such that an end thereof on the lower end side of the corrugated fin 30 is positioned lower than the other end thereof on the upper end side of the corrugated fin 30.

According to this configuration, during defrosting, it is possible to slide down the frost 35 to both of the adjacent flat tubes 10*a* and 10*b*, not to only one of the adjacent flat tubes 10*a* and 10*b*. Accordingly, it is possible to melt the slid-down frost 35 on both the flat tubes 10*a* and 10*b*, and thus it is possible to shorten the defrosting time period. Moreover, it is possible to drain water of melted frost generated due to defrosting, downward along the corrugated fin 30 without interruption of flow in the middle.

In addition, the production apparatus for the corrugated fin according to Embodiment 1 includes: the supply unit 50 that supplies the band-shaped thin plate 51; the shaping unit 60 that shapes the thin plate 51 supplied from the supply unit 50, into a corrugated shape; and the cutting unit 70 that cuts the thin plate 51 shaped by the shaping unit 60 to produce the corrugated fin 30. The shaping unit 60 includes the pair of shaping rollers 61 and 62 that mesh with each other with the thin plate 51 intervening therebetween. The plurality of teeth 61*a* to 61*c* and 62*a* to 62*d* having shapes different from each other are formed on the outer peripheral surfaces of the pair of shaping rollers 61 and 62.

According to the production apparatus for the corrugated fin, it is possible to easily produce the corrugated fin 30 of the corrugated fin heat exchanger according to Embodiment 1.

In addition, the method for producing the corrugated fin heat exchanger according to Embodiment 1 includes a step of producing the corrugated fin 30 by using the production apparatus for the corrugated fin.

According to the method for producing the corrugated fin heat exchanger, it is possible to easily produce the corrugated fin heat exchanger according to Embodiment 1.

Embodiment 2

Figure 12:
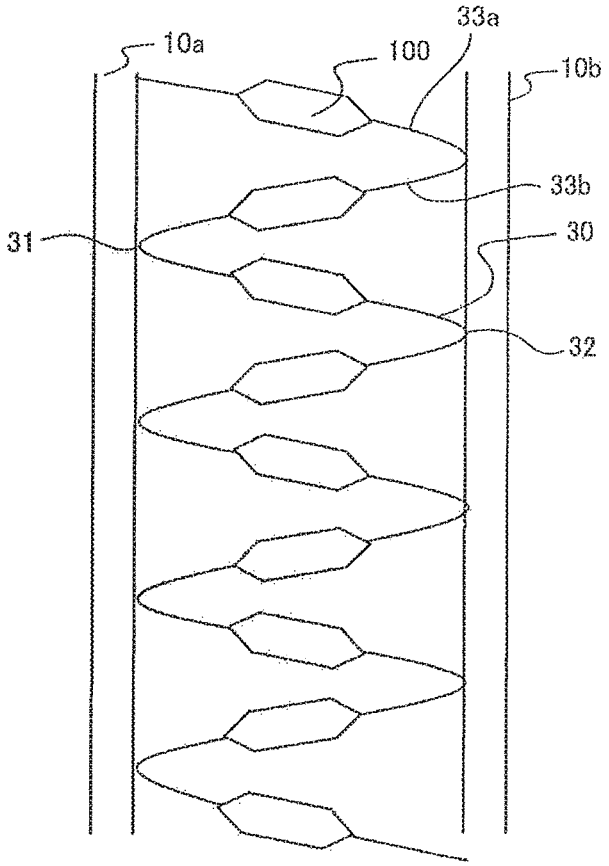
FIG. 12 is a front view showing the configuration of a corrugated fin 30 in a corrugated fin heat exchanger according to Embodiment 2 of the present invention.

A corrugated fin heat exchanger according to Embodiment 2 of the present invention will be described. FIG. 12 is a front view showing the configuration of a corrugated fin 30 in the corrugated fin heat exchanger according to Embodiment 2. Components having the same functions and operations as in Embodiment 1 are designated by the same reference signs, and the description thereof is omitted.

As shown in FIG. 12, the corrugated fin 30 of Embodiment 2 has a louver 100 formed at each slant portion 33*a* or 33*b*. The louver 100 of Embodiment 2 is provided to each slant portion 33*a* or 33*b* and at the center portion between the flat tubes 10*a* and 10*b*. The louver 100 is, for example, a cut/raised-type louver formed by cutting and raising the slant portion 33*a* or 33*b*. Here, the position of the louver 100 is not limited to the center portion between the flat tubes 10*a* and 10*b*, and the louver 100 may be provided so as to be closer to one of the flat tubes 10*a* and 10*b*. In addition, the louver 100 may be provided over the entire surface of each slant portion 33*a* or 33*b* other than the vicinities of the top portions 31 and 32.

Figure 13:
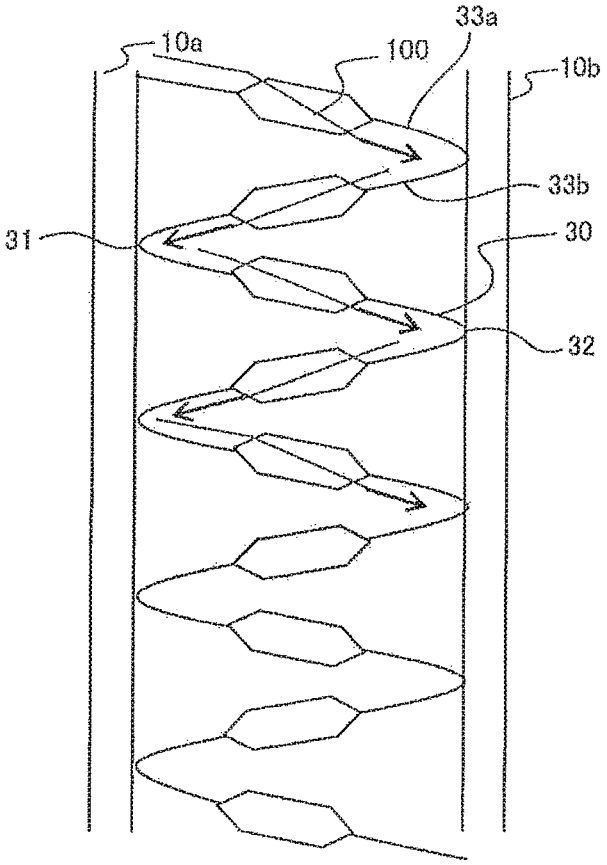
FIG. 13 is an explanatory diagram showing an example of behavior of water of melted frost during defrosting in the corrugated fin heat exchanger according to Embodiment 2 of the present invention.

Next, an operation during defrosting of the corrugated fin heat exchanger according to Embodiment 2 will be described. FIG. 13 is an explanatory diagram showing an example of behavior of water of melted frost during defrosting in the corrugated fin heat exchanger. In FIG. 13, an example of flow of the water of melted frost is shown by arrows.

As shown in FIG. 13, in the corrugated fin heat exchanger of Embodiment 2, water of melted frost generated due to defrosting is not only drained downward on the corrugated fin 30 and the flat tubes 10*a* and 10*b*, but also drained through an opening formed by the louver 100. Thus, water of melted frost flowing on the upper surface (upward-facing surface) of the corrugated fin 30 easily flows to the lower surface (downward-facing surface) of the corrugated fin 30 through the opening formed by the louver 100.

As described above, in the corrugated fin heat exchanger according to Embodiment 2, the louver 100 is formed at each of the plurality of slant portions 33*a* and 33*b*. According to this configuration, it is possible to improve the transferring performance of the heat exchanger by the front edge effect of the louver 100.

In addition, according to Embodiment 2, it is possible to drain water of melted frost generated during defrosting, in the gravity direction via the louver 100. Accordingly, the number of drainage paths for water of melted frost increases, and thus it is possible to shorten the time period required for water drainage.

In addition, according to Embodiment 2, since it is possible to allow water of melted frost from above to flow into the vertex angle side (inner side) of the top portions 31 and 32 of the corrugated fin 30, it is possible to drain downward water of melted frost that exceeds a water-holding allowable limit at the top portions 31 and 32. Moreover, by discharging water of melted frost accumulated at the top portions 31 and 32, it is possible to decrease the amount of water held in the entirety of the corrugated fin heat exchanger. Therefore, it is possible to prevent the heat exchanger from being broken due to expansion of water during re-frosting.

Embodiment 3

Figure 14:
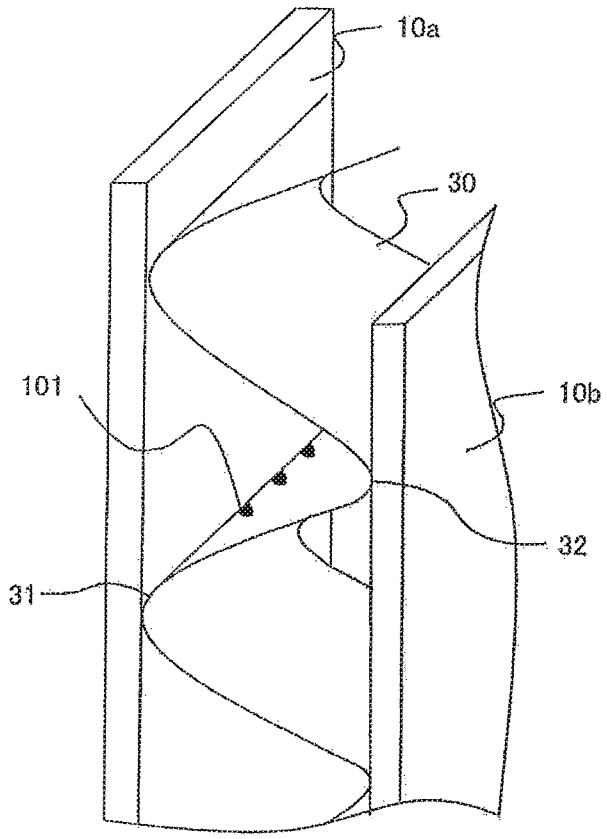
FIG. 14 is a perspective view showing the configuration of a corrugated fin 30 in a corrugated fin heat exchanger according to Embodiment 3 of the present invention.

A corrugated fin heat exchanger according to Embodiment 3 of the present invention will be described. FIG. 14 is a perspective view showing the configuration of a corrugated fin 30 in the corrugated fin heat exchanger according to Embodiment 3. Components having the same functions and operations as in Embodiment 1 are designated by the same reference signs, and the description thereof is omitted.

As shown in FIG. 14, the corrugated fin 30 of Embodiment 3 has a plurality of slits 101 (through holes) formed so as to penetrate between one surface and the other surface. The slits 101 are provided to portions that are in contact with the flat tube 10 (the top portions 31, 32), or in the vicinities thereof.

Figure 15:
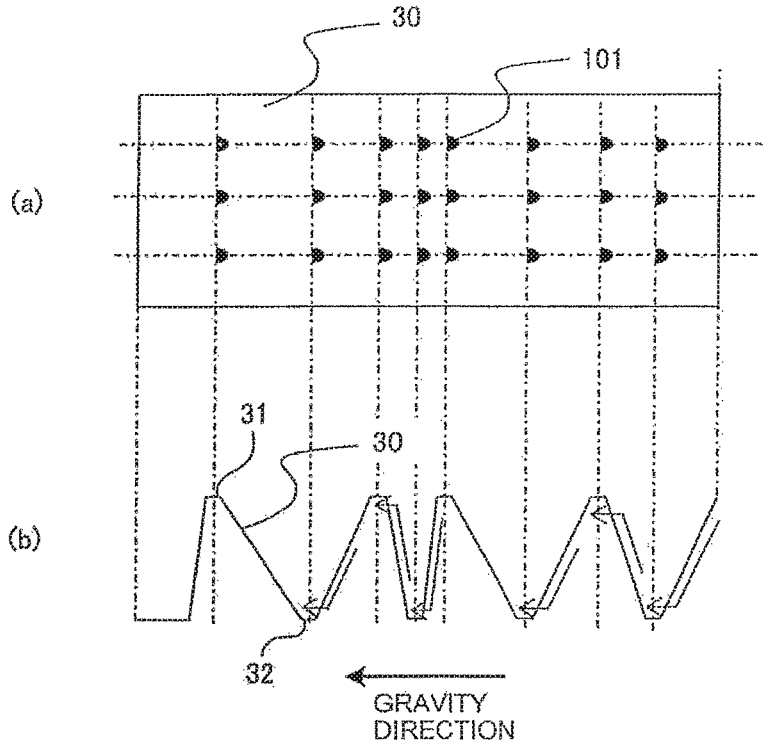
FIG. 15 is a diagram showing a front view (a) and a side view (b) of the corrugated fin 30 in the corrugated fin heat exchanger according to Embodiment 3 of the present invention.

FIG. 15 is a diagram showing a front view (a) and a side view (b) of the corrugated fin 30. The leftward direction in FIG. 15 represents the gravity direction. In (b) of FIG. 15, an example of flow of water of melted frost is indicated by arrows. As shown in FIG. 15, the slits 101 of this example have a semi-elliptical shape and are provided to a portion above each top portion 31 or 32 (e.g., above the centers of the top portions 31 and 32.

Figure 16:
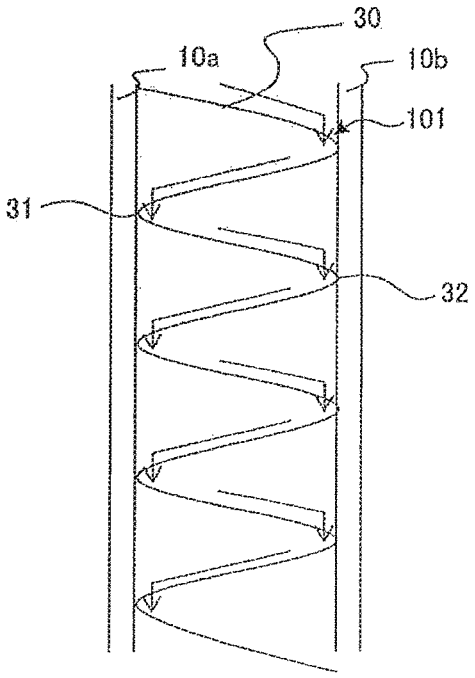
FIG. 16 is an explanatory diagram showing an example of behavior of water of melted frost during defrosting in the corrugated fin heat exchanger including the corrugated fin 30 shown in FIG. 15.

FIG. 16 is an explanatory diagram showing an example of behavior of water of melted frost during defrosting in the corrugated fin heat exchanger including the corrugated fin 30 shown in FIG. 15. In FIG. 16, an example of flow of water of melted frost is shown by arrows. As shown in FIG. 16, in the configuration of this example, water of melted frost is drained downward on the corrugated fin 30 while flowing down from the upper surface of the corrugated fin 30 to the lower surface via the slits 101.

Figure 17:
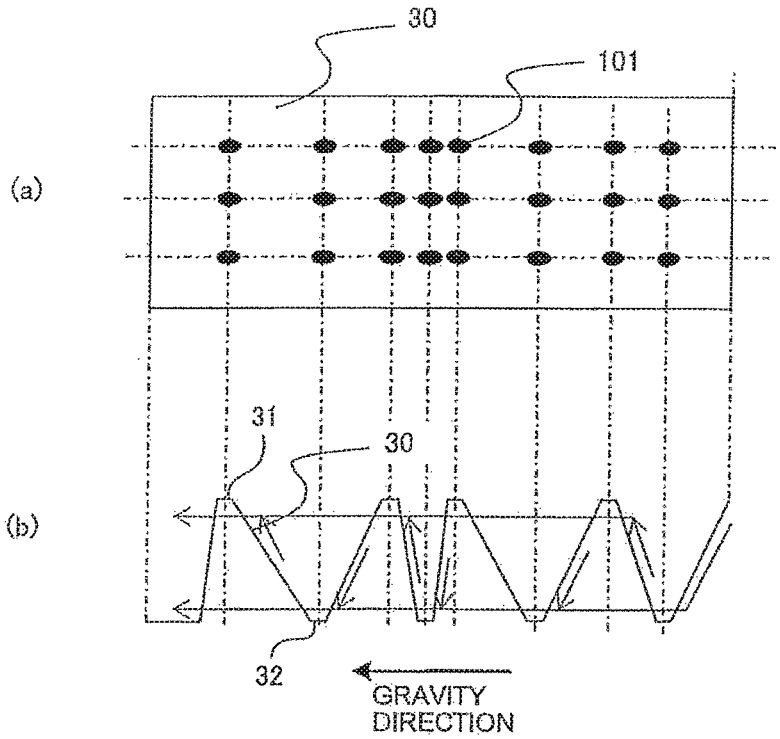
FIG. 17 is a diagram showing a modification of the corrugated fin 30 in the corrugated fin heat exchanger according to Embodiment 3 of the present invention.

FIG. 17 is a diagram showing a modification of the corrugated fin 30. The leftward direction in FIG. 17 represents the gravity direction. In (b) of FIG. 17, an example of flow of water of melted frost is indicated by arrows. As shown in FIG. 17, the slits 101 of this modification have an elliptical shape and are provided to upper portions and lower portions of the top portions 31 and 32.

Figure 18:
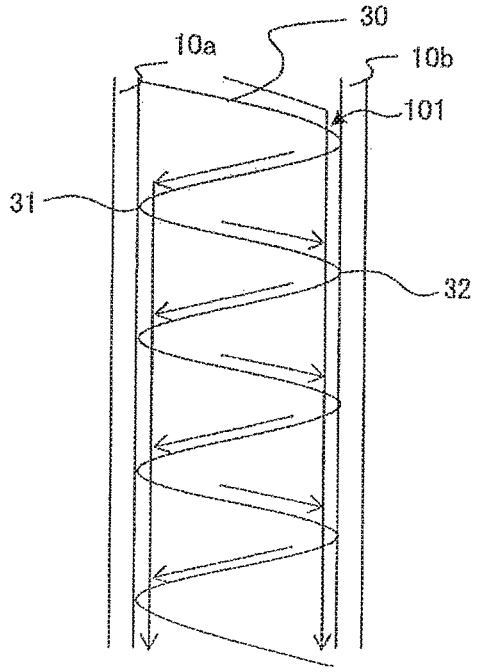
FIG. 18 is an explanatory diagram showing an example of behavior of water of melted frost during defrosting in the corrugated fin heat exchanger including the corrugated fin 30 shown in FIG. 17.

FIG. 18 is an explanatory diagram showing an example of behavior of water of melted frost during defrosting in the corrugated fin heat exchanger including the corrugated fin 30 shown in FIG. 17. In FIG. 18, an example of flow of water of melted frost is shown by arrows. As shown in FIG. 18, in the configuration of this modification, water of melted frost flows downward on the corrugated fin 30, and also flows in the gravity direction on the flat tubes 10 through the slits 101. Therefore, according to the configuration of this modification, it is possible to drain the water of melted frost on the corrugated fin 30, and it is also possible to drain the water of melted frost in the gravity direction on the flat tubes 10.

As described above, in the corrugated fin heat exchanger according to Embodiment 3, the slits 101 are formed in the corrugated fin 30. In addition, the slits 101 are provided to the top portions 31 and 32 in the corrugated fin heat exchanger according to Embodiment 3.

According to this configuration, it is possible to drain water of melted frost generated during defrosting, in the gravity direction through the slits 101. Accordingly, the number of drainage paths for water of melted frost increases, and thus it is possible to shorten the time period required for water drainage. In addition, according to this configuration, it is possible to immediately drain water of melted frost that is generated due to melting of frost and has slid down from the slant portions 33*a* and 33*b* to the top portions 31 and 32, as compared to a configuration in which no slit 101 is provided.

In addition, according to this configuration, since the drainage paths are provided to the top portions 31 and 32 on which water of melted frost easily collects, it is possible to more assuredly drain water of melted frost. In addition, since it is possible to drain water of melted frost collecting on the top portions 31 and 32, it is possible to prevent the heat exchanger from being broken due to expansion of water during re-frosting.

In addition, according to this configuration, since the drainage paths are provided to the top portions 31 and 32 on which water of melted frost easily collects, it is possible to decrease the amount of water held in the entirety of the corrugated fin heat exchanger.

Embodiment 4

Figure 19:
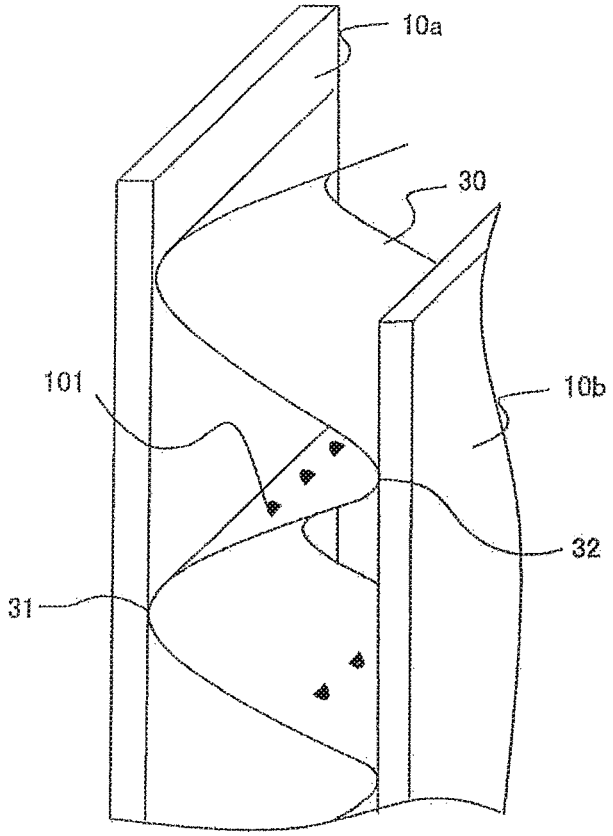
FIG. 19 is a perspective view showing the configuration of a corrugated fin 30 in a corrugated fin heat exchanger according to Embodiment 4 of the present invention.

A corrugated fin heat exchanger according to Embodiment 4 of the present invention will be described. FIG. 19 is a perspective view showing the configuration of a corrugated fin 30 in the corrugated fin heat exchanger according to Embodiment 4. Components having the same functions and operations as in Embodiment 1 are designated by the same reference signs, and the description thereof is omitted.

As shown in FIG. 19, a plurality of slits 101 are formed in the corrugated fin 30 of Embodiment 4 so as to penetrate between one surface and the other surface. The slits 101 are provided to slant portions 33*a* and 33*b* (e.g., above top portions 31 and 32 of the slant portions 33*a* and 33*b*). Contact surfaces of the corrugated fin 30 with each flat tube 10 are formed over the entirety in the width direction of the corrugated fin 30.

Figure 20:
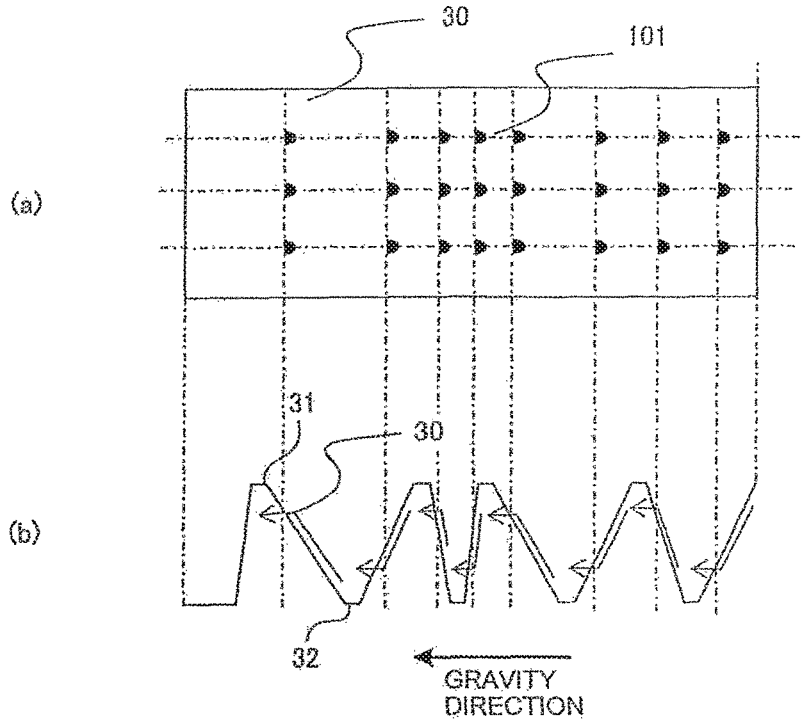
FIG. 20 is a diagram showing a front view (a) and a side view (b) of the corrugated fin 30 in the corrugated fin heat exchanger according to Embodiment 4 of the present invention.

FIG. 20 is a diagram showing a front view (a) and a side view (b) of the corrugated fin 30. The leftward direction in FIG. 20 represents the gravity direction. In (b) of FIG. 20, an example of flow of water of melted frost is indicated by arrows. As shown in FIG. 20, the slits 101 are provided, for example, below the center portion of each slant portion 33*a* or 33*b*.

Figure 21:
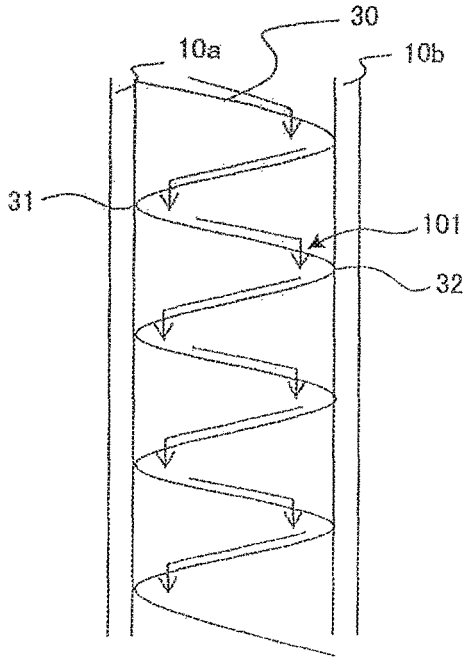
FIG. 21 is an explanatory diagram showing an example of behavior of water of melted frost during defrosting in the corrugated fin heat exchanger according to Embodiment 4 of the present invention.

FIG. 21 is an explanatory diagram showing an example of behavior of water of melted frost during defrosting in the corrugated fin heat exchanger according to Embodiment 4. In FIG. 21, an example of flow of the water of melted frost is indicated by arrows. As shown in FIG. 21, in the configuration of this example, the water of melted frost flows downward on the corrugated fin 30 through the slits 101.

As described above, in the corrugated fin heat exchanger according to Embodiment 4, the slits 101 are formed in the corrugated fin 30. In addition, in the corrugated fin heat exchanger according to Embodiment 4, the slits 101 are provided to a plurality of the slant portions 33*a* and 33*b*.

According to this configuration, it is possible to drain water of melted frost generated during defrosting, in the gravity direction through the slits 101. Accordingly, the number of drainage paths for water of melted frost increases, and thus it is possible to shorten the time period required for water drainage.

In addition, according to Embodiment 4, since the slits 101 are provided to the slant portions 33*a* and 33*b*, it is possible to prevent the area of contact between the corrugated fin 30 and each flat tube 10 from decreasing, as compared to the configuration of Embodiment 3. Therefore, it is possible to efficiently transmit heat during defrosting from each flat tube 10 to the corrugated fin 30, and it is also possible to immediately drain water of melted frost.

Other Embodiments

The present invention is not limited to Embodiments 1 to 4 described above, and various modifications may be made.

For example, in Embodiments 1 to 4 described above, the air-conditioning apparatus has been taken as an example of the refrigeration cycle apparatus, but the present invention is also applicable to refrigeration cycle apparatuses other than the air-conditioning apparatus.

In addition, Embodiments 1 to 4 and the modifications described above may be combined with each other and practiced.

REFERENCE SIGNS LIST

1 compressor 2 four-way valve 3 heat source side heat exchanger 4 pressure reducing device 5 load side heat exchanger 6, 7 air-sending fan 10, 10*a*, 10*b* flat tube 12 upper header 13 lower header 30 corrugated fin 31, 31-1, 31-2, 31-3, 31-4, 32, 32-1, 32-2, 32-3, 32-4 top portion 33*a*, 33*a*1, 33*a*2, 33*a*3, 33*a*4, 33*a*5, 33*b*, 33*b*1, 33*b*2, 33*b*3, 33*b*4 slant portion 35 frost 50 supply unit 51 thin plate 60 shaping unit 61, 62 shaping roller 61*a*, 61*b*, 61*c*, 62*a*, 62*b*, 62*c*, 62*d* tooth 70 cutting unit 100 louver 101 slit θ, θ1*a*, θ1*b*, θ1*c*, θ2*a*, θ2*b*, θ2*c*, θ2*d* vertex angle φ, φ1, φ2, φ3, φ4, φ5, φ6, φ7, φ8, φ9 angle of inclination

The invention claimed is:

1. A corrugated fin heat exchanger for causing an internal fluid to flow in a vertical direction, the corrugated fin heat exchanger comprising:

a first flat tube;

a second flat tube aligned in parallel with the first flat tube; and a corrugated fin disposed between the first flat tube and the second flat tube, the corrugated fin including a fin pattern, wherein the fin pattern includes:

a first slant portion bridging between the first flat tube and the second flat tube, the first slant portion being inclined at a first angle to a first perpendicular line that extends perpendicular to the first flat tube and the second flat tube, a second slant portion bridging between the first flat tube and the second flat tube, the second slant portion being inclined at a second angle to a second perpendicular line that extends perpendicular to the first flat tube and the second flat tube, and an adjacent pair of third slant portions bridging between the first flat tube and the second flat tube, the adjacent pair of third slant portions directly connecting the first slant portion to the second slant portion, and the adjacent pair of third slant portions each being inclined at a third angle and a fourth angle, respectively, to a third perpendicular line that extends perpendicular to the first flat tube and the second flat tube, wherein each of the first angle, the second angle, the third angle, and the fourth angle is an acute angle, and the third angle and the fourth angle are each larger than the first angle and the second angle.

2. The corrugated fin heat exchanger of claim 1, wherein each of the first angle and the second angle is 10.05 degrees or less, and the third angle and fourth angle of the adjacent pair of third slant portions is greater than 10.05 degrees.

3. The corrugated fin heat exchanger of claim 1, wherein the corrugated fin includes a plurality of slant portions including the first slant portion, the second slant portion, and the adjacent pair of third slant portions, and among the plurality of slant portions, the number of slant portions inclined at an angle greater than 10.05 degrees relative to the perpendicular line toward the first flat tube is smaller than the number of slant portions inclined at an angle of 10.05 degrees or less relative to the perpendicular line toward the first flat tube.

4. The corrugated fin heat exchanger of claim 1, wherein each of the first slant portion, the second slant portion, and the adjacent pair of third slant portions is formed such that an end thereof on a lower end side of the corrugated fin is positioned lower than an other end thereof on an upper end side of the corrugated fin.

5. The corrugated fin heat exchanger of claim 1, wherein a louver is formed at each of the first slant portion, the second slant portion, and the adjacent pair of third slant portions.

6. The corrugated fin heat exchanger of claim 1, wherein a slit is formed in the corrugated fin.

7. The corrugated fin heat exchanger of claim 6, wherein the slit is provided to a portion above each top portion of the corrugated fin, the each top portion of the corrugated fin being in contact with the first flat tube or the second flat tube.

8. The corrugated fin heat exchanger of claim 7, wherein the slit has a semi-elliptical shape.

9. The corrugated fin heat exchanger of claim 6, wherein the slit is provided to a top portion of the corrugated fin that is in contact with the first flat tube or the second flat tube.

10. The corrugated fin heat exchanger of claim 6, wherein the slit is provided to the first slant portion, the second slant portion, and the adjacent pair of third slant portions.

11. The corrugated fin heat exchanger of claim 1, wherein the first angle opens toward the first flat tube, the second angle opens toward the second flat tube, the third angle opens toward the second flat tube, and the fourth angle opens toward the second flat tube.

12. A refrigeration cycle apparatus, comprising:

a refrigeration circuit that includes a compressor, a four-way valve, a heat source side heat exchanger, a pressure reducing valve, and a load side heat exchanger connected by piping, wherein at least one of the heat source side heat exchanger and the load side heat exchanger is a corrugated fin heat exchanger for causing an internal fluid to flow in a vertical direction, the corrugated fin heat exchanger comprising:

a first flat tube;

a second flat tube aligned in parallel with the first flat tube; and a corrugated fin disposed between the first flat tube and the second flat tube, the corrugated fin including a fin pattern, wherein the fin pattern includes:

a first slant portion bridging between the first flat tube and the second flat tube, the first slant portion being inclined at a first angle to a first perpendicular line that extends perpendicular to the first flat tube and the second flat tube, a second slant portion bridging between the first flat tube and the second flat tube, the second slant portion being inclined at a second angle to a second perpendicular line that extends perpendicular to the first flat tube and the second flat tube, and an adjacent pair of third slant portions bridging between the first flat tube and the second flat tube, the adjacent pair of third slant portions directly connecting the first slant portion to the second slant portion, and the adjacent pair of third slant portions each being inclined at a third angle and a fourth angle, respectively, to a third perpendicular line that extends perpendicular to the first flat tube and the second flat tube, wherein each of the first angle, the second angle, the third angle, and the fourth angle is an acute angle, and the third angle and the fourth angle are each larger than the first angle and the second angle.

13. A production apparatus for producing a corrugated fin to be used in the corrugated fin heat exchanger of claim 1, the production apparatus comprising:

a supply unit configured to supply a band-shaped thin plate;

a shaping unit configured to shape the thin plate supplied from the supply unit, into a corrugated shape; and a cutting unit configured to cut the thin plate shaped by the shaping unit, to produce the corrugated fin;

the shaping unit including a pair of shaping rollers meshing with each other with the thin plate intervening therebetween; and a plurality of teeth having shapes different from each other being formed on an outer peripheral surface of each of the pair of shaping rollers.

14. A production method for producing the corrugated fin heat exchanger of claim 1, the production method comprising:

a step of producing the corrugated fin by using the production apparatus for the corrugated fin comprising:

a supply unit configured to supply a band-shaped thin plate;

a shaping unit configured to shape the thin plate supplied from the supply unit, into a corrugated shape; and a cutting unit configured to cut the thin plate shaped by the shaping unit, to produce the corrugated fin;

wherein the shaping unit includes a pair of shaping rollers meshing with each other with the thin plate intervening therebetween, and a plurality of teeth having shapes different from each other are formed on an outer peripheral surface of each of the pair of shaping rollers.

* * * * *